US010245757B2

(12) United States Patent
Gildersleeve et al.

(10) Patent No.: US 10,245,757 B2
(45) Date of Patent: Apr. 2, 2019

(54) MOLD EXTRACTOR ASSEMBLY FOR CONCRETE PRODUCTS FORMING MACHINE

(71) Applicant: Columbia Machine, Inc., Vancouver, WA (US)

(72) Inventors: Stacy Gildersleeve, Woodland, WA (US); Emerson Kneipp, Vancouver, WA (US)

(73) Assignee: COLUMBIA MACHINE, INC., Vancouver, WA (US)

( * ) Notice: Subject to any disclaimer, the term of this patent is extended or adjusted under 35 U.S.C. 154(b) by 415 days.

(21) Appl. No.: 14/991,626

(22) Filed: Jan. 8, 2016

(65) Prior Publication Data

US 2017/0197339 A1 Jul. 13, 2017

(51) Int. Cl.
*B28B 7/10* (2006.01)
*B28B 17/00* (2006.01)

(52) U.S. Cl.
CPC ..... *B28B 17/009* (2013.01)

(58) Field of Classification Search
CPC ..... B28B 17/009; B66F 9/141
See application file for complete search history.

(56) References Cited

U.S. PATENT DOCUMENTS 3,624,825 A * 11/1971 Heitzman ..... B28B 7/08 249/74
4,472,127 A * 9/1984 Cyriax ..... B29C 31/006 264/328.7
5,330,306 A * 7/1994 Pemberton ..... B65G 1/0485 414/282
5,362,434 A * 11/1994 Hauser ..... B28B 17/009 264/239
6,352,236 B1 * 3/2002 Aaseth ..... B28B 3/022 249/119
2006/0182840 A1 * 8/2006 High ..... B28B 1/081 425/432
2006/0245862 A1 * 11/2006 Hansl ..... B65G 1/0435 414/281

OTHER PUBLICATIONS

Columbia Machine, Inc., Model CPM, May 11, 2010, Youtube, video, https://www.youtube.com/watch?v=6pqPDxB50XY (Year: 2010).*

* cited by examiner

*Primary Examiner* — William P Bell
*Assistant Examiner* — Andrew L Swanson
(74) *Attorney, Agent, or Firm* — Schaffer IP Law, LLC

(57) ABSTRACT

A mold extractor assembly for use with a concrete products forming machine of a type having mold mount shelves and a feed box assembly mounted behind the mold mount shelves and moveable in a vertical and horizontal direction to dispense concrete into cavities defined within a mold box mounted on the shelves. The mold extractor assembly comprises a guide rail assembly horizontally oriented along and vertically moveable with the feed box assembly. An extractor arm assembly is moveable along the guide rail assembly in a horizontal direction toward the mold mount shelves. An extractor fork assembly is telescopically nested about the extractor arm assembly and configured to extend a horizontal reach of the mold extractor assembly to beyond the mold mount shelves so that the mold box can be lifted off of the mold mount shelves via the extractor fork assembly and carried forwardly to a mold transfer assembly.

9 Claims, 11 Drawing Sheets

MOLD EXTRACTOR ASSEMBLY FOR CONCRETE PRODUCTS FORMING MACHINE

BACKGROUND OF THE INVENTION

1. Field of the Invention

This invention relates generally to mold box assemblies and more particularly to such assemblies which are used to form molded products such as concrete products and which include structures for assisting in the exchange of one mold box with another within a concrete products forming machine (CPM).

2. Description of the Prior Art

Prior art machines for forming concrete products within a mold assembly include a product forming section comprising a stationary frame, an upper compression beam and a lower stripper beam. The mold assembly includes a head assembly that is mounted on the compression beam, and a mold box that is mounted on the frame and receives concrete material from a feed drawer. An example of such a system is shown in U.S. Pat. No. 5,807,591 which describes an improved concrete products forming machine (CPM) assigned in common to the assignee of the present application and herein incorporated by reference for all purposes.

In use, the feed drawer moves concrete material over the top of the mold box and dispenses the material into the contoured cavities of the mold box. The feed drawer typically includes an agitator assembly within the drawer that operated to break up the concrete and improve its consistency prior to dropping it into the mold. As the concrete material is dispensed, a vibration system shakes the mold box to spread the concrete material evenly within the mold box cavities in order to produce a more homogeneous concrete product. A wiper assembly, mounted to the front of the feed drawer, acts to scrape excess concrete from the shoes when the feed drawer is moved to an operative position above the mold box.

After the concrete is dispensed into the mold cavities, the feed drawer retracts from over the top of the mold box. A spreader, bolted separately to the front of the feed drawer, scrapes off excess concrete from the top of the mold when the feed drawer is retracted after filling the mold cavities. The compression beam then lowers, pushing shoes from the head assembly into corresponding cavities in the mold box. The shoes compress the concrete material during the vibration process. After compression is complete, the stripper beam lowers as the head assembly pushes further into the cavities against the molded material. A molded concrete product thereby emerges from the bottom of the mold box onto a pallet and is conveyed away for curing and a new pallet moved in its place beneath the underside of the mold assembly.

The mold box and head assembly are matched together and configured to form concrete products in a specific shape, size, and number. Each product configuration requires a different mold. When the operator desires the CPM to produce products in different configurations, the mold must be detached from mounts on the CPM and removed along with the assembly. A different mold box and head assembly must then be moved into place and mounted within the CPM.

Conventional methods for changing molds out in a CPM are typically labor intensive and result in a lot of downtime with the machine, leading to lost revenue. Accordingly, there is need for an improved system and method for better automating the process for changing molds within a concrete products forming machine that minimizes these drawbacks.

SUMMARY OF THE INVENTION

The invention consists of a two stage, well guided, hydraulic cylinder actuated telescoping mechanism attached to the underside of a top plate assembly of the feed drawer section of a concrete products forming machine. The two stage telescoping function allows the device to discretely position a mold in one of two horizontal positions, the first extended position is where the mold assembly is raised and lowered off of or onto the die supports with mold alignment dowels of the upper vibrator assembly located in the center section assembly of the concrete products forming machine. The second extended position is where the mold assembly is raised or lowered off of or onto a mold transfer cassette. A third fully retracted position keeps the mechanism stored when mold changes are not being performed. The vertical motion is controlled by an axis of motion already used in adjusting the top plate assembly of the feed drawer section of the concrete products forming machine into place for production.

The invention includes several new and useful features. First, the discrete horizontal positions and the use of tapered alignment blocks eliminate the chance of horizontal misalignment during the mold change process. Second, the telescoping functionality reduces the space requirements for operation and shipping, keeping the device within the envelope of the basic machine. Additionally, using the vertical motion of the existing top plate assembly eliminates the need for dedicated actuators to position the mold extractor assembly.

The purpose of the invention is to allow a mold assembly to be removed from the machine automatically and without use of hand tools or external overhead lifting devices, providing an increased isolation of the operator from the dangers associated with most mold change processes of industrial concrete product forming machines. This invention has the advantage of not requiring an additional vertical axis of motion by using the existing axis of the top plate assembly of the feed drawer section of the concrete products forming machine. An additional advantage of this system is its modular nature, allowing it to be integrated into an existing concrete products forming machine, thereby reducing the machine cost whereas many existing systems are integral to the machine and cannot be purchased without it.

The foregoing and other objects, features and advantages of the invention will become more readily apparent from the following detailed description of a preferred embodiment of the invention that proceeds with reference to the accompanying drawings.

DETAILED DESCRIPTION

Figure 1:
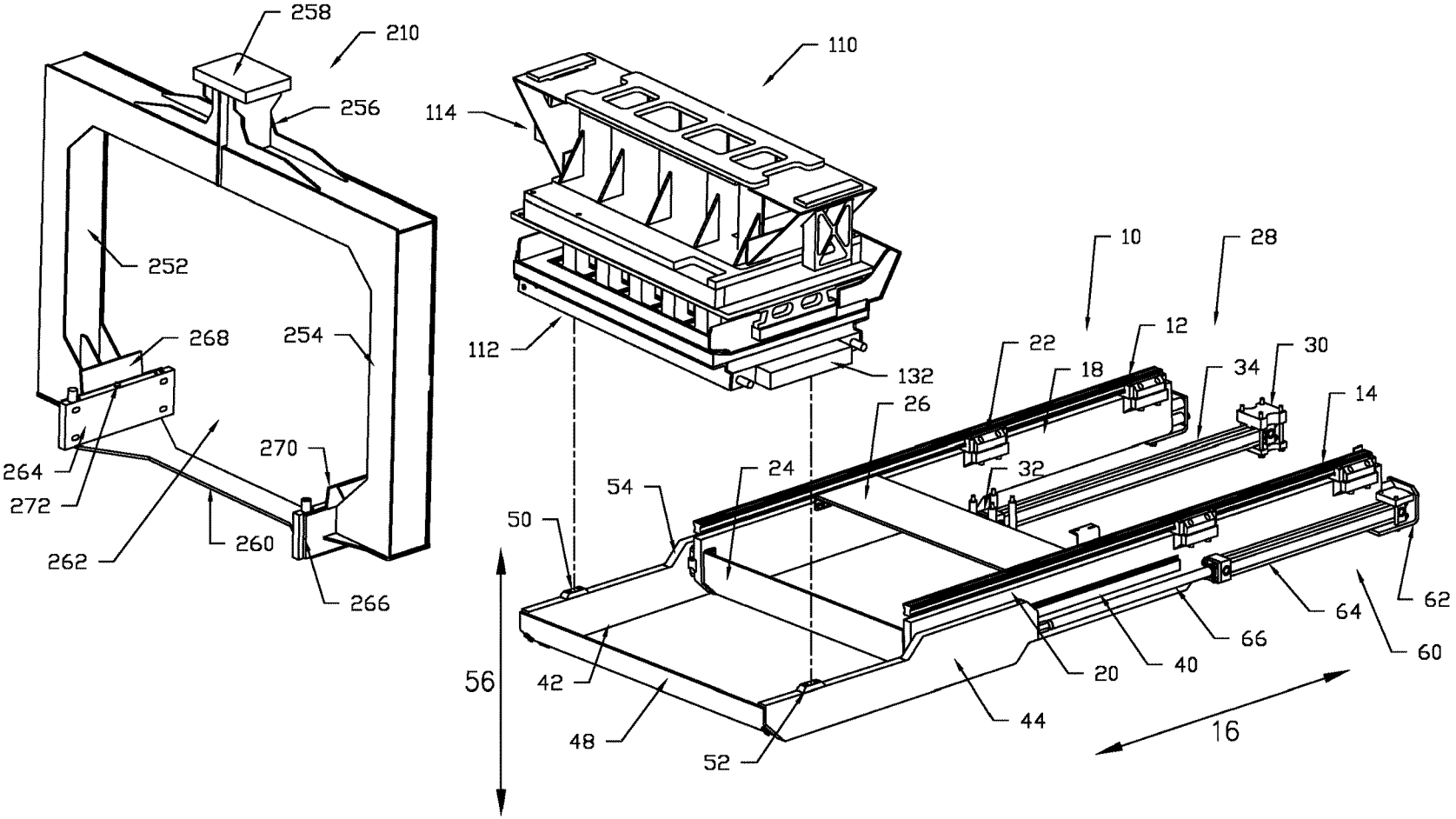
FIG. 1 is a perspective view of a mold extractor assembly of the present invention in a first extended position relative to a mold box assembly and mold cassette assembly.
Figure 6:
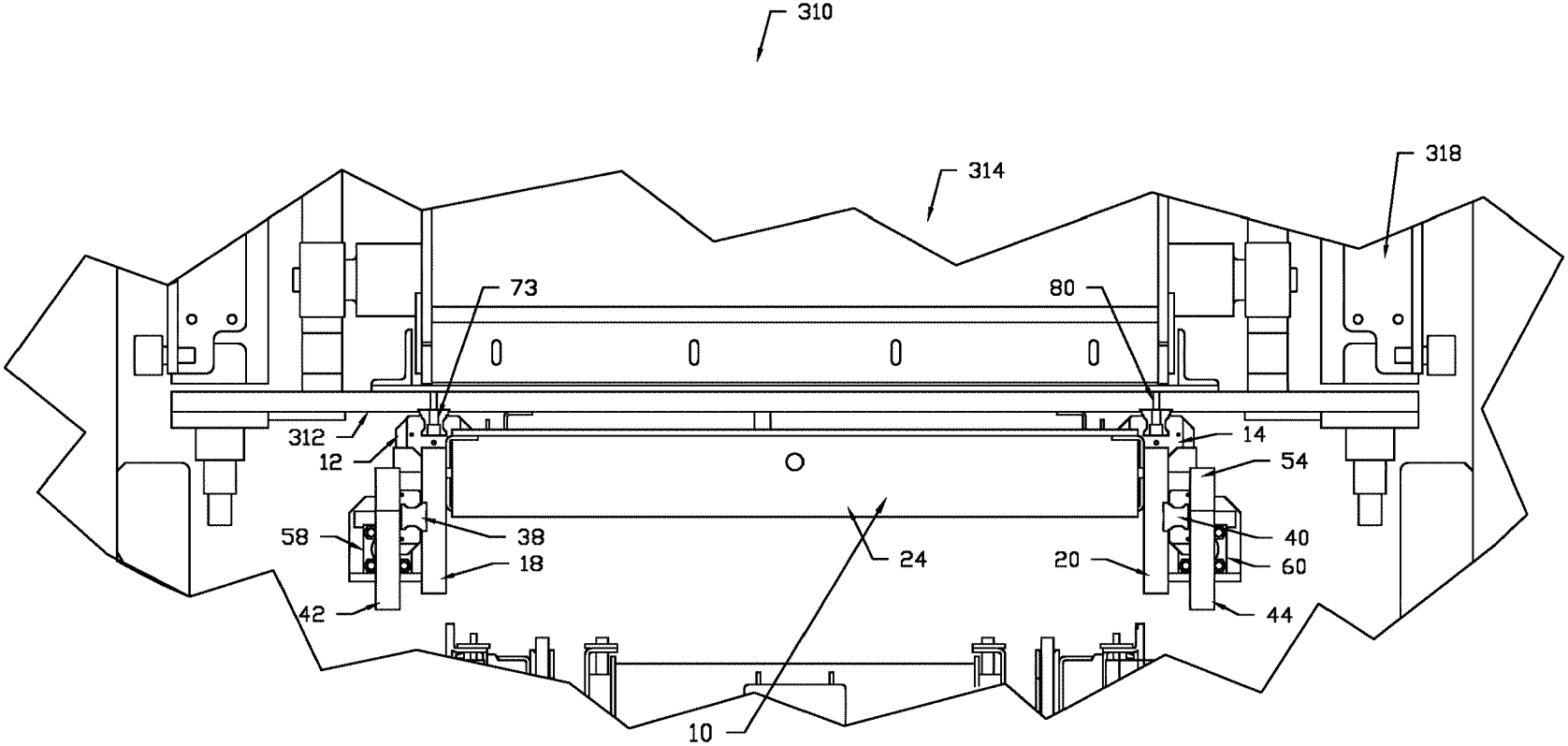
FIG. 6 is a front elevation view of the mold extractor assembly taken along lines 6-6 in FIG. 4.

FIG. 1 shows a mold extraction assembly 10 in combination with a mold assembly 110 and mold cassette assembly 210. Extraction assembly 10 includes a set of inner guide rails 12, 14 coupled along their length to a top plate assembly of the feed drawer section of a concrete products forming machine (FIG. 6). Guide rails 12, 14 extend parallel to a mold extraction path 16 and include grooves running longitudinally along the length of the rails on opposed sides. A pair of mold extraction arms 18, 20 are disposed just underneath the inner guide rails 12, 14 and are slidingly connected thereto via sets of guide blocks, such as extraction arm guide block 22, that are affixed to upper ends of the arms 18, 20 and slide within the grooves formed in the sides of the guide rails.

Figure 2:
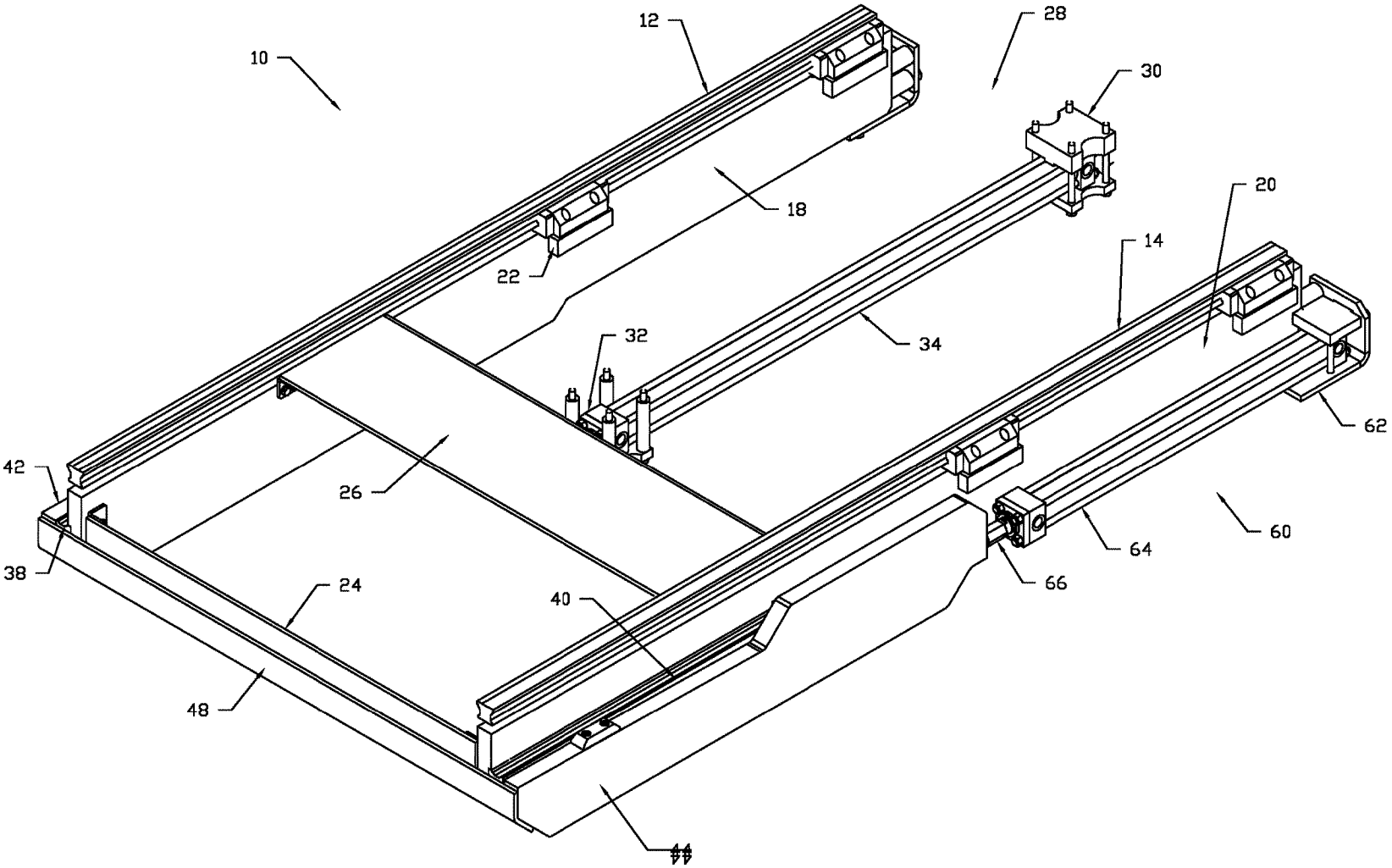
FIG. 2 is a perspective view of the mold extractor assembly of FIG. 1 shown in a retracted position.

Extraction arms 18, 20 are coupled together via a front bracing plate 24 and a rearwardly disposed cross-bracing plate 26 running between top ends of the arms. A hydraulic cylinder 28 is positioned along a central axis of the extraction assembly 10 and includes a cylinder mount block 30 at a rear end and a cylinder support block 32 at a front end mounted upward to the top plate assembly of the feed drawer section of the concrete products forming machine. A cylinder housing 34 is fixedly coupled between the mount block 30 and support block 32 and receives a hydraulic piston 36. A terminal end of the hydraulic piston 36 is coupled to an underside of the cross-bracing plate 26 spanning between extraction arms 18, 20. Actuation of the hydraulic cylinder 28 causes the piston 36 to extend out of the end of the housing 34 and push the plate 26, thereby causing the connected arms 18, 20 to slide forwardly along the inner guide rails 12, 14 to an extended position. Likewise, the hydraulic piston 36 may be retracted into the housing 34 and withdraw the arms 12, 14 to a retracted position as shown in FIG. 2.

Mold extraction assembly 10 further includes a set of outer guide rails 38, 40, with each affixed to outside walls of respective extraction arms 18, 20 and extending parallel to the inner guide rails 12, 14 and mold extraction path 16. A pair of mold extraction forks 42, 44 are telescopically nested about the arm assembly and slidingly coupled to respective arms 18, 20 via a set of guide blocks, such as extraction fork guide block 46 (hidden in FIG. 1, but shown in FIG. 3B), that allow the forks to move slidingly along the length of the rails 38, 40 and extend the forward reach of the mold extraction assembly 10. Forks 42, 44 are coupled together at a front end by a spreader plate 48. Each of the forks includes a tapered alignment block, such as blocks 50, 52, that extend upward from a top surface of the forks and mate (see broken lines) with complementary apertures (FIG. 7) formed on the underside of a mold assembly 110. The tapering narrows to the upper surface of the alignment blocks 50, 52, preferably in the direction of extraction 16 so as to accommodate for tolerances with positioning the forks in relation to the mold assembly 110 as described further below. More preferably, the tapered surface has a principal taper in a direction parallel with the outside track, and a minor taper in a horizontally orthogonal direction to that track. Forks 42, 44 are profiled with an angled surface 54 coupling the thicker rear end with the narrower front end to optimize section stiffness and weight.

Horizontal movement of the arm assembly is implemented by a pair of hydraulic cylinders 58, 60 coupled via a bracket (e.g. bracket 62) affixed to a back end of respective extraction arms 18, 20. Cylinders each include a cylinder housing 64 fixedly coupled to bracket 62 and a hydraulic piston 66 received in the housing and extending parallel to the extraction path 16. A terminal end of the hydraulic piston 66 is coupled to a rear end of a respective fork 44. Actuation of the hydraulic cylinders 60 causes the piston 66 to extend out of the end of the housing 64 and push the fork 44, thereby causing the fork assembly to slide forwardly along the outer guide rails 38, 40 to an extended position. Likewise, the hydraulic piston 66 may be retracted into the housing 64 and withdraw the forks 42, 44 to a retracted position as shown in FIG. 2.

Figure 3A:
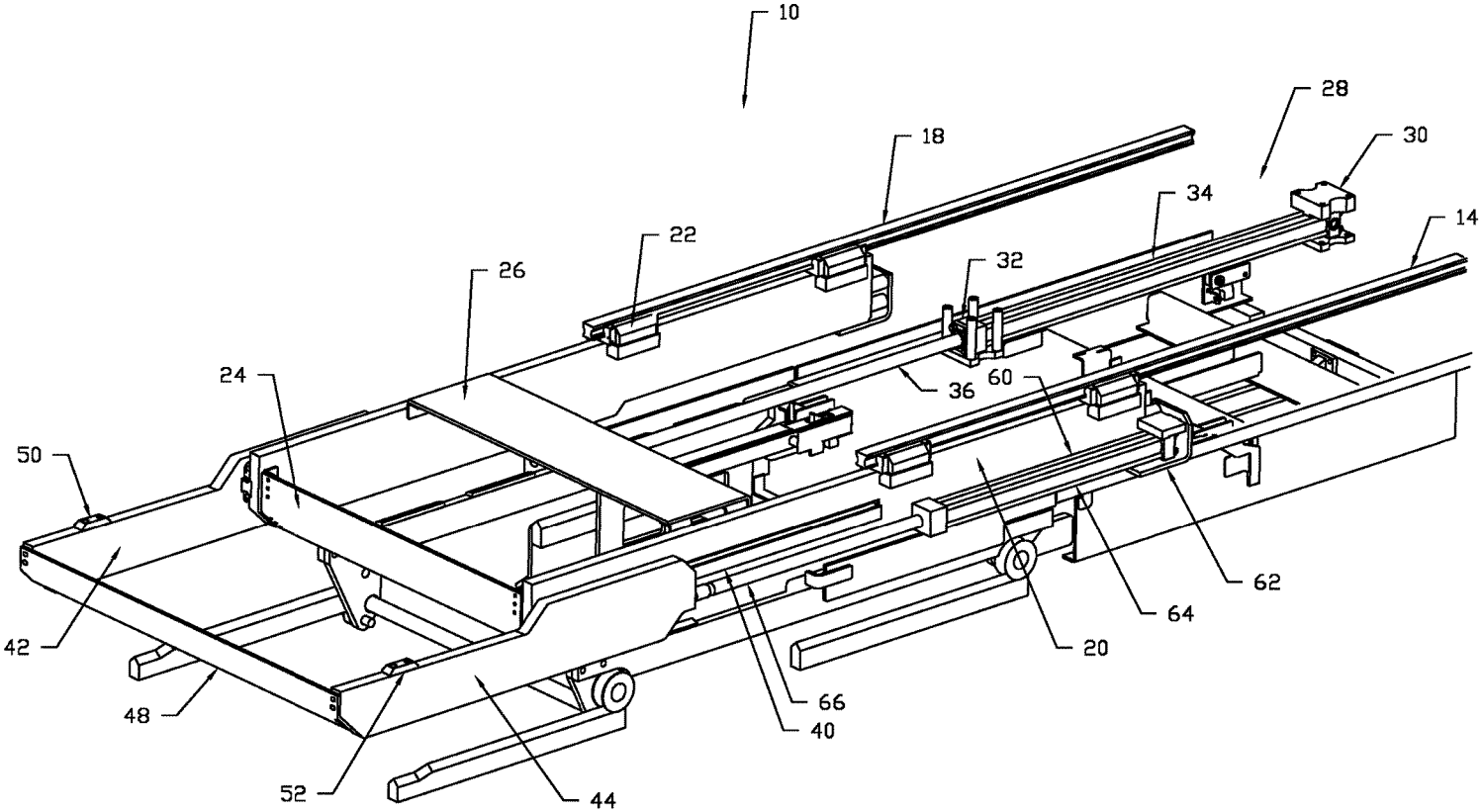
FIGS. 3A and 3B are perspective and top plan views, respectively, of the mold extractor assembly of FIG. 1 shown in a fully extended position.
Figure 3B:
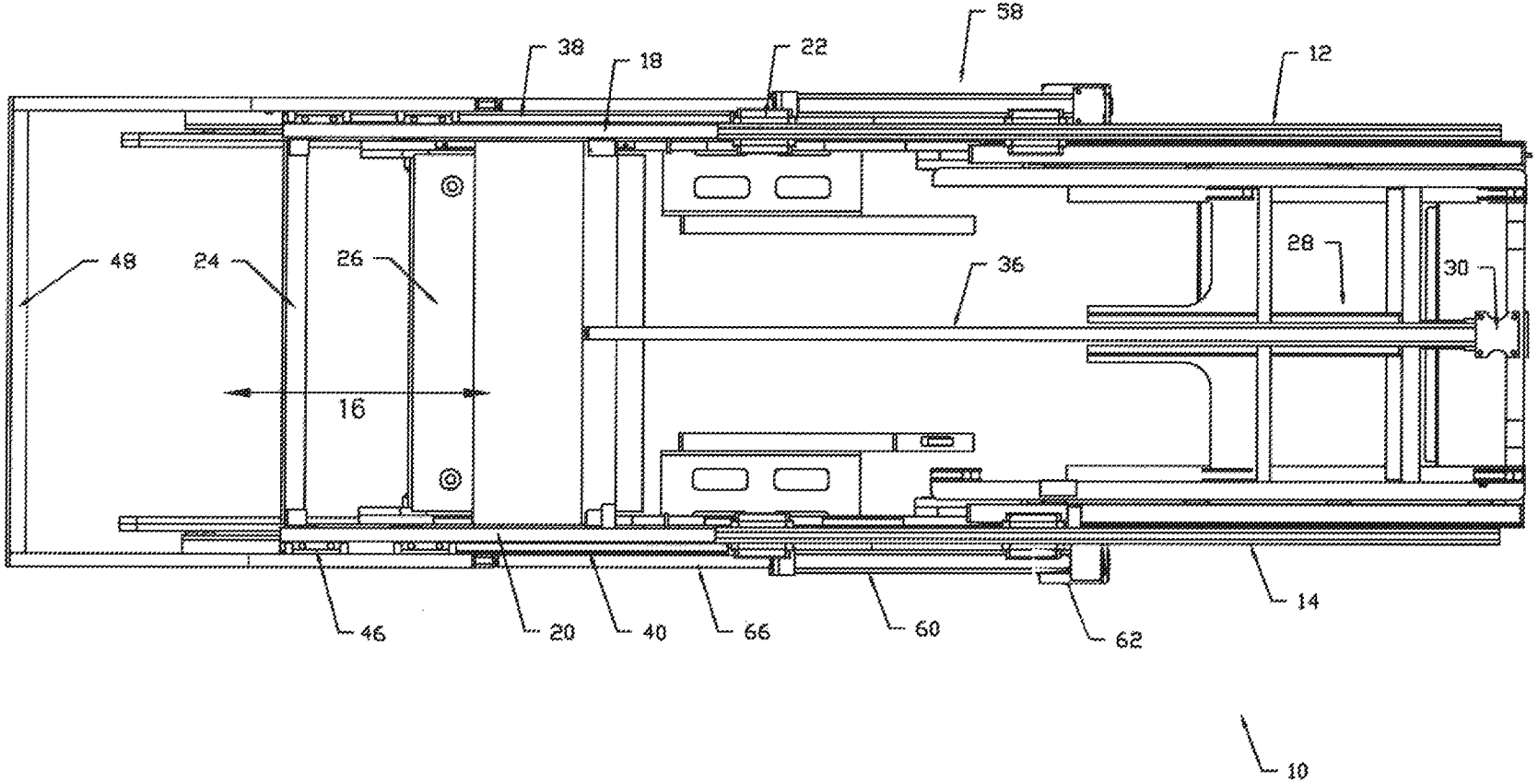

Vertical movement 56 of the mold extraction assembly 10 via means described further below acts to approach and lift the mold assembly 110 from below so it can be placed on either the concrete products machine shelves 134 or the cassette assembly 210 shelves 264, 266 during a mold exchange process. Retraction and extension of the mold extraction assembly occurs in three phases: (1) the fully retracted position is shown in FIG. 2; (2) the partially extended position is shown in FIG. 1 so that the forks 42, 44 are positioned below mold assembly 110 mounted on a CPM; and (3) the fully extended position as shown in FIGS. 3A/3B where both the forks and the arms are extended along respective rails/tracks 38, 40, 12, 14.

The mold assembly 110 includes a mold box portion 112 and a head assembly portion 114 that are fitted together in alignment with one another for mounting together onto a concrete products forming machine as described further below. Assemblies 112 and 114 are constructed to form mold concrete products having a certain size and configuration, whereas different mold assemblies can have differently configured assemblies resulting in different products. As the exchange of one mold assembly with another on a concrete products forming machine typically requires a large amount of manual labor and downtime, enabling an automated exchange of one mold assembly with another using the extraction assembly described herein is a key goal of the invention.

Generally, mold box 112 includes a body with a front wall and a back wall joined together with side walls and having cavities for receiving and molding the concrete products. The side walls each have a side face that spans between a bottom facing surface of the side face and a top facing surface.

A mounting bracket extension 132 is coupled to each side wall of the mold box 112 to extend the width of the mold assembly 110. In use, the front and back walls of the mold box 112 are sized for extending substantially between a pair of shelves 134 (FIG. 7), also referred to as die supports 134, on a concrete product forming machine to thus allow the mold box 112 to sit directly on top of and span between the shelves. The mounting bracket extensions 132 can be used to extend narrower mold boxes to mount to various CPMs, although such features may not be necessary if the bottom facing surfaces of the sidewalls are wide enough to accommodate the die alignment and mold transfer features described further below. The mounting bracket extensions 132 in combination with the side walls thus form the lower mounting surface of the mold assembly onto these shelves 134 of the concrete products forming machine.

Formed in an underside of this lower mounting surface are die alignment holes 136 (FIG. 7) adjacent an outer periphery of the mold box. When a mounting bracket extension 132 is necessary for extending the width of the mold assembly 110, these die alignment holes 136 are formed in each mounting bracket extension and configured to receive a respective alignment dowel 138 (FIG. 7) extending upward from the shelves of the concrete products forming machine.

Figure 7:
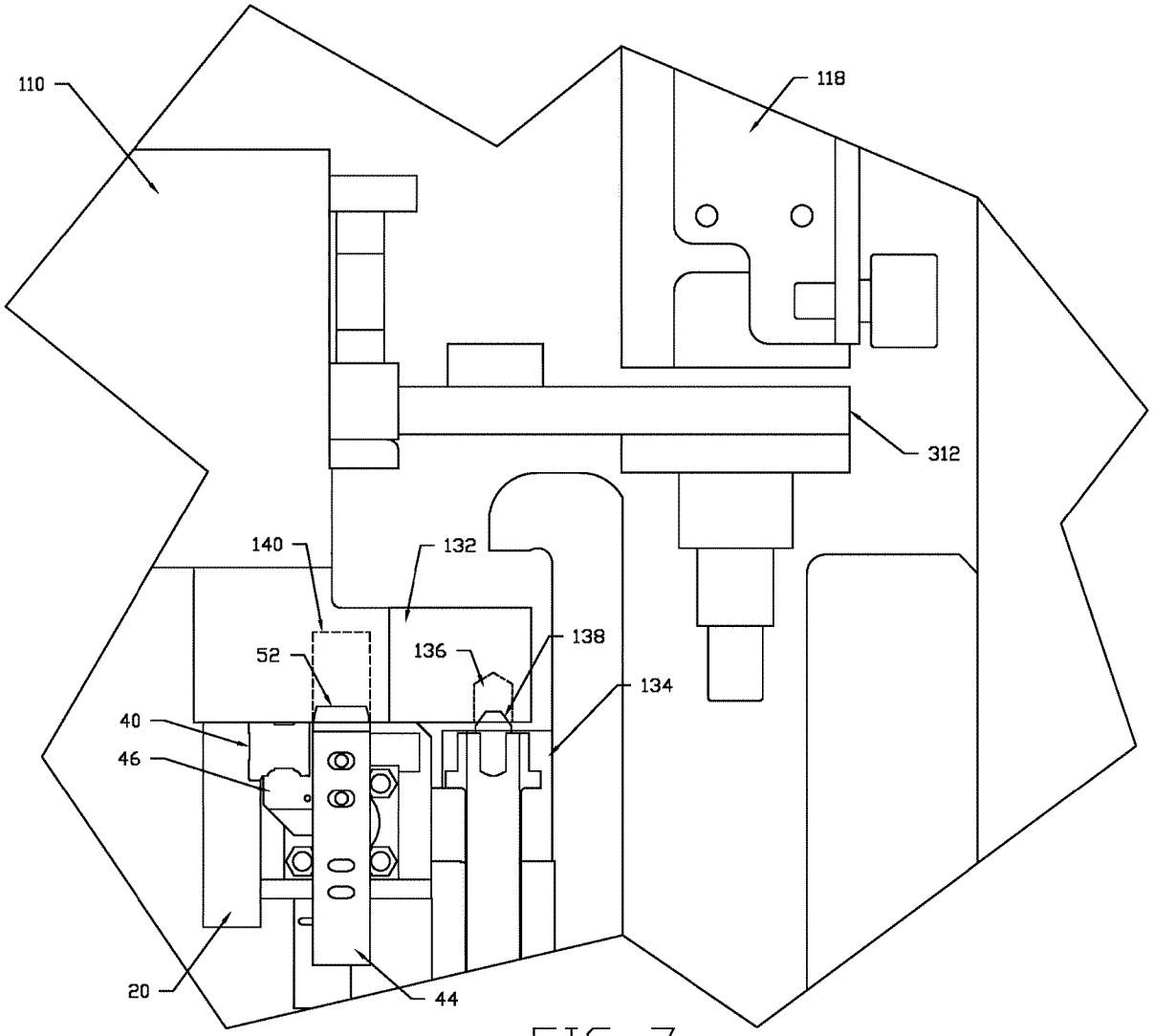
FIG. 7 is a front elevation magnified view showing a portion of the mold extractor assembly lifting a mold assembly off of shelves and alignment dowels of a concrete products forming machine according to teachings of the invention.

Mold transfer locators 140 (FIG. 7) are formed on the lower mounting surface of the mold box 112, inboard of the die alignment holes and shelves of the concrete products forming machine. In one embodiment, locators 140 are recesses formed in the lower mounting surface that extend to an inner wall of the mold side walls. Locators 140 are configured to precisely locate the mold box onto mold extractor forks 42, 44 when the mold box is lifted off of the alignment dowels by the mold extractor forks during a mold extraction process as described further below. In use, these mold transfer locators 140 receive the tapered alignment blocks 50, 52 formed atop the forks 42, 44 of the mold extraction device 10. The forks 42, 44 of the extraction device 10 are configured to move between the CPM shelves 134 and lift upward against the inward portion of the lower mounting surface of the mold assembly, this inward portion being that portion that does not sit directly atop the CPM shelves. FIG. 7 illustrates fork 44 lifting up against a lower portion of mold box 110 that is inboard (e.g. to the left) of the bracket extension 132. The tapered alignment blocks are received within the mold transfer locators, e.g. block 52 received within locator 140, and the mold assembly 110 is lifted off of the shelves 134 for transport away from the CPM. A new mold box is then installed on the CPM in a reverse process and the production cycle is then restarted to form newly configured molded products.

FIG. 1 shows details of the cassette 210 used in mold transfer assembly. Cassette 210 includes two C-section frames 252, 254 coupled together at the top by a central weldment post 256 on which sits a top plate 258. Cassette frame sections 252, 254 are coupled together at the bottom by a spreader plate 260 that maintains the spacing between the frame sections. Spreader plate is located at the lowest portion of the cassette 210 so as to provide a large central opening 262 within the cassette through which a mold assembly, such as assembly 110, may be received.

Coupled on either side of the spreader plate 260 are features configured to guide and retain a mold assembly within the cassette. A pair of shelves 264, 266 are spaced on each side of the spreader plate 260. The shelves are spaced an identical distance apart as the shelves or die supports 134 on the CPM to which the mold assemblies are operatively mounted. The pair of shelves 264, 266 are separated by a central expanse configured to receive the forks 42, 44 of a mold exchange assembly, noting that the spreader plate 260 is located below the bottom surface of the shelves to establish a height of the vertical expanse between the shelves 264, 266. The height of the vertical expanse—and in this case the height of shelves 264, 266—is large enough so as to accommodate the height of a front end of the mold extractor forks 42, 44 and prevent collision with the spreader plate 260 when the forks have set the mold assembly 110 onto the top surface of shelves 264, 266 and is then withdrawn back to a retracted position.

A pair of inwardly sloped guide plates 268, 270 are coupled to outside peripheral sections of the shelves. These plates 268, 270 are angled from a wider top spacing to a narrower bottom spacing and are configured to provide surfaces that guide the mold onto the shelves. Mold alignment dowels 272 are centrally located on a top surface of each of the shelves 264, 266. In use, the mold extraction device 10 would lift mold assembly 110 from the shelves 134 on the CPM and carry it through the opening 262 of cassette 210. The mold extraction device would then lower the mold assembly 110 onto cassette shelves 264, 266 so that apertures on an underside of the mold assembly receive dowels 272.

Figure 4:
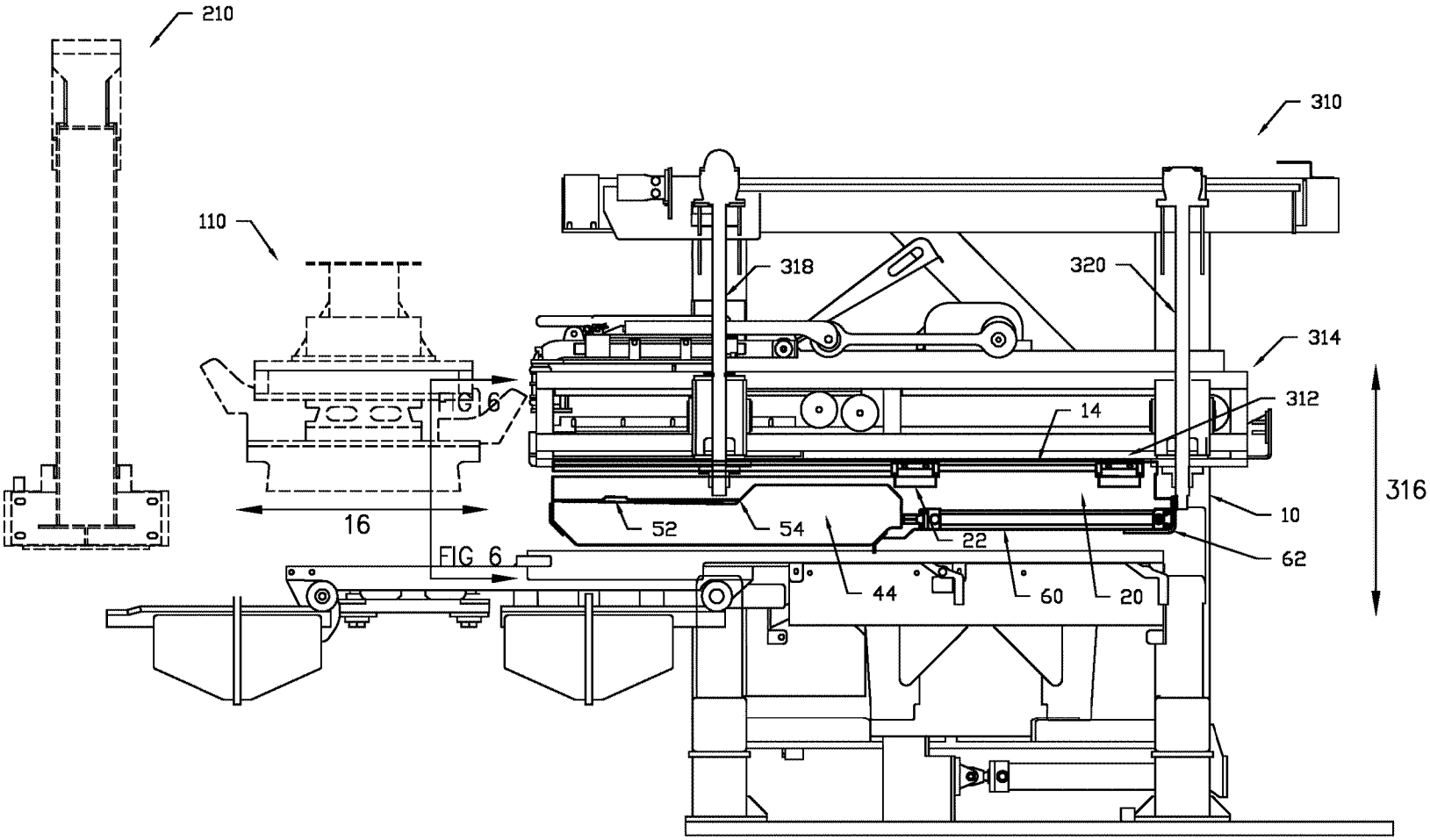
FIG. 4 is a side elevation view of the mold extractor assembly of FIG. 1 installed within a feed box assembly of a concrete products forming machine with a mold assembly and mold cassette assembly shown in broken lines.

FIG. 4 shows a side view of the mold extraction assembly 10 coupled to the underside of a feed drawer assembly 310. Feed drawer assembly 310 is a structure located to the rear of a CPM center section (not shown) and the mold 110 mounted thereon (shown in broken lines). The mold extraction assembly 10 is coupled to a mounting plate 312 affixed to the underside of the feed drawer 314 of assembly 310. Vertical movement 316 of the feed drawer 314 and coupled mold extraction assembly 10 is implemented via a set of screw lifts 318, 320 that would ordinarily be part of the feed drawer assembly system in a conventional CPM such as that available from Columbia Machine, Inc. The mold extraction assembly 10, when in a fully retracted position as shown in FIG. 4, fits within the envelope of the feed drawer assembly 310 and uses the preexisting vertical lift system 318, 320 to raise and lower, particularly the forks 42, 44 of the extraction assembly 10 into contact with an underside of the mold assembly 110. The mold assembly 110 is then lifted and carried forward along extraction route 16 to the cassette assembly 210 whereupon the mold is set down onto the cassette shelves 264, 266 and onto alignment dowels 272.

Figure 5A:
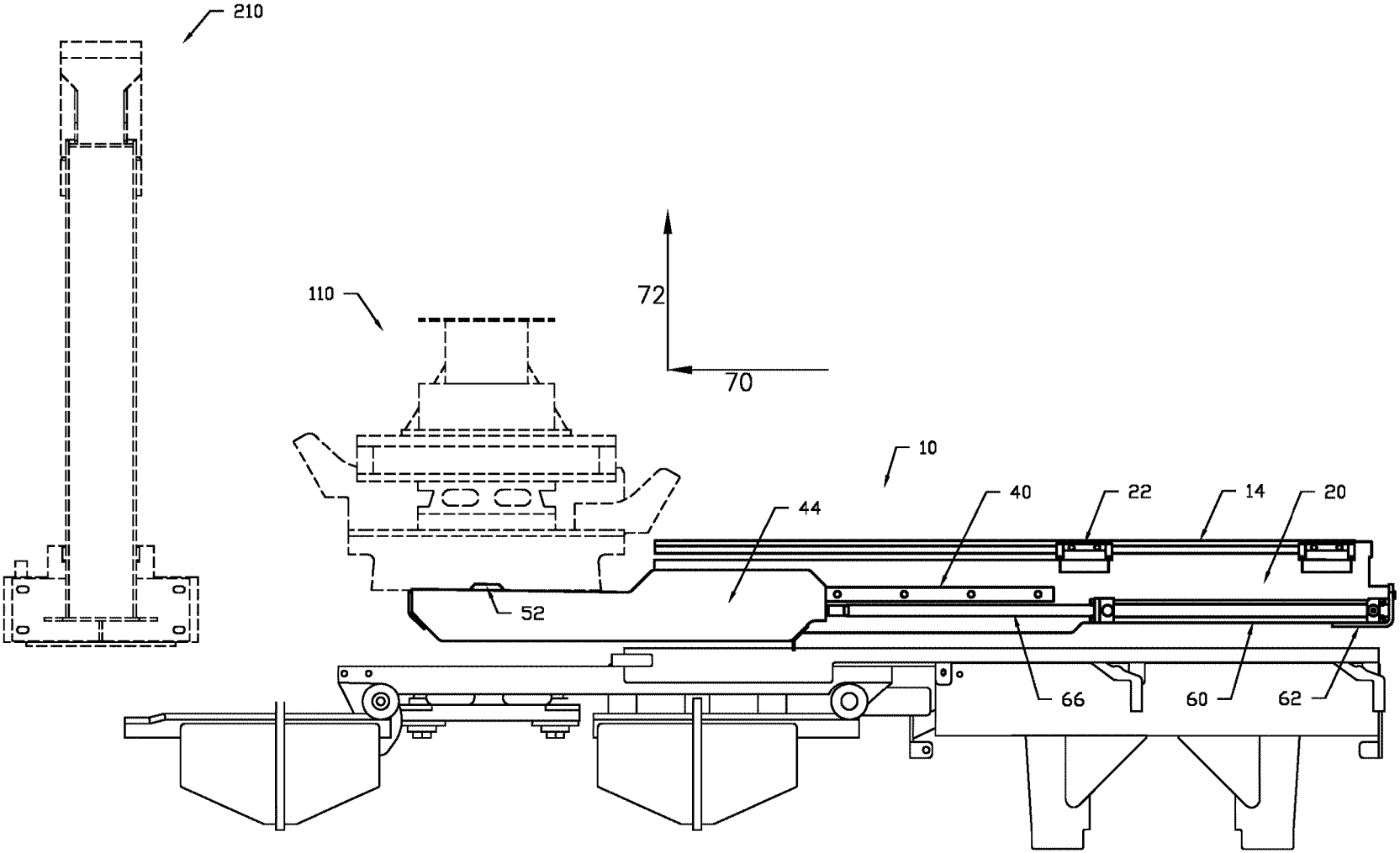
FIG. 5A through 5C are side elevations views of the mold extractor assembly in progressive extension and elevation steps during a mold extraction process.
Figure 5B:
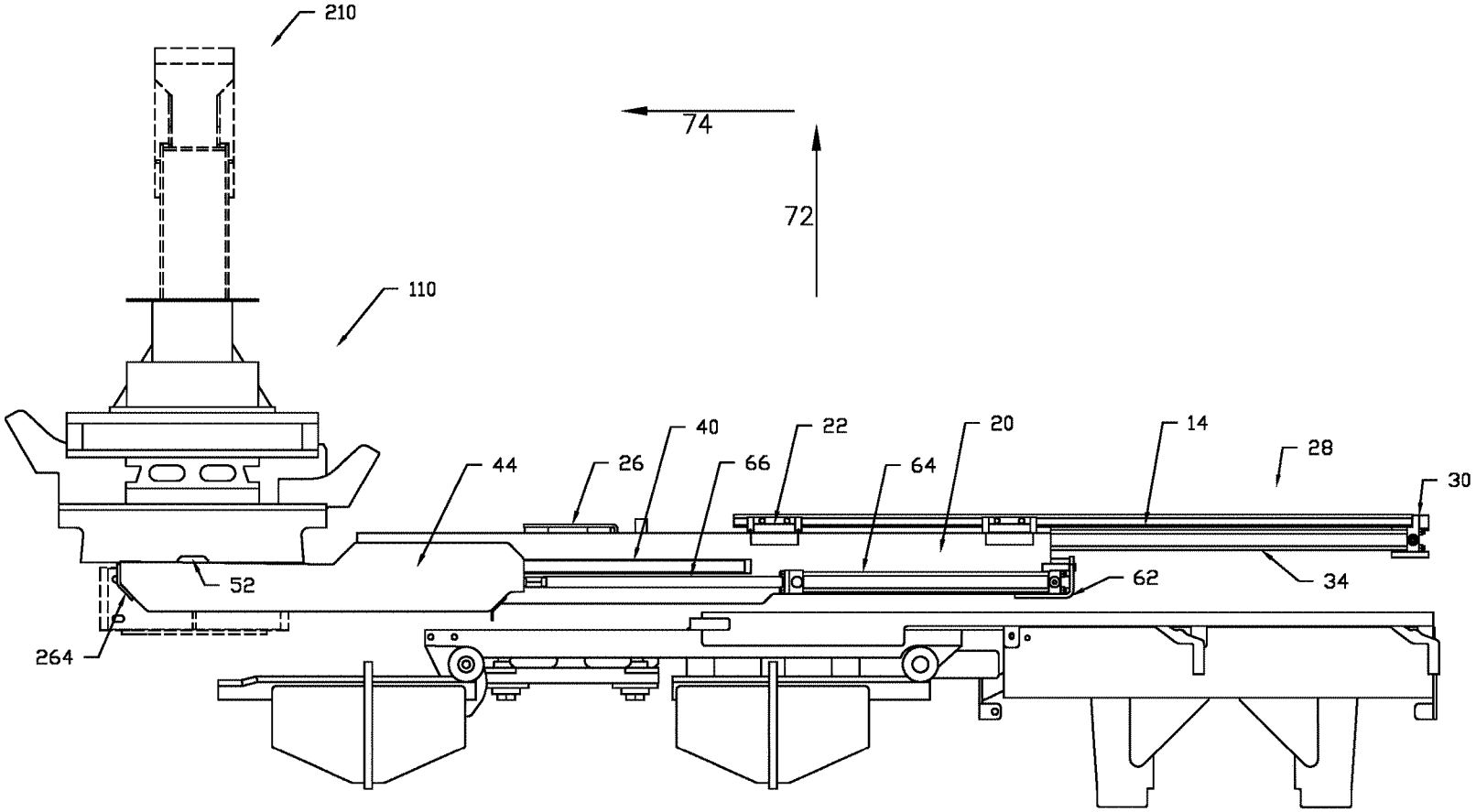
Figure 5C:
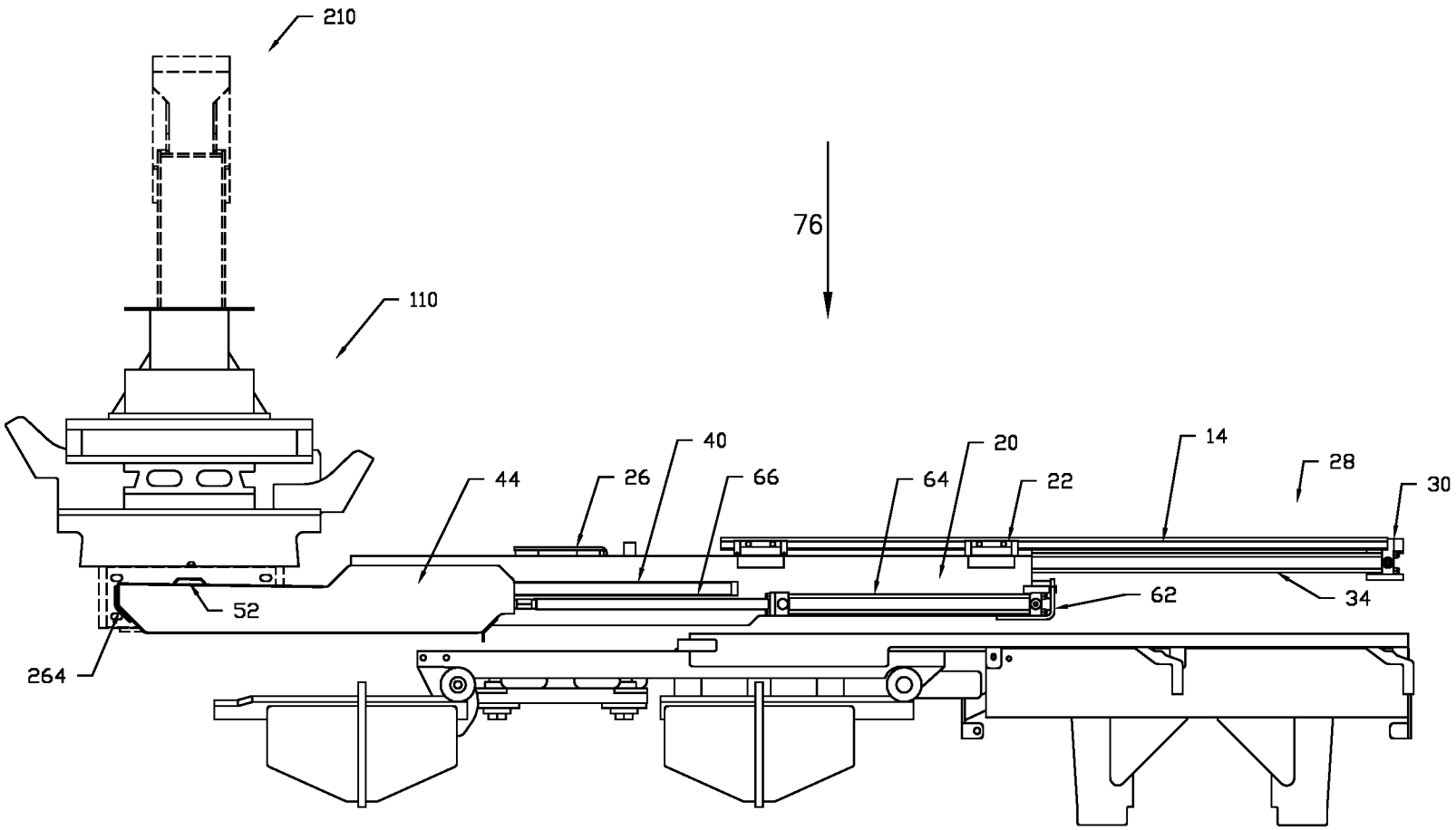

FIGS. 5A-5C illustrate three separate extension phases of the mold extraction device 10. In FIG. 5A, the mold extraction forks 42, 44 are pushed forward 70 via hydraulic cylinders 58, 60 to an extended position so that the mold alignment block structures 50, 52 on the tops of the forks 42, 44 are aligned with complementary structures on the underside of mold assembly 110. The feed box lifting structure 318, 320 then raise 72 the feed box and attached mold extraction assembly 10, and alignment blocks 50, 52 are received within the complementary structures on the mold assembly and the mold is lifted off of the CPM shelves.

FIG. 5B shows the mold extraction assembly in a fully extended and raised position while retaining the mold assembly 110. The mold extraction arms 18, 20 are pushed forward 74 via hydraulic cylinder 28 to an extended position so that—in combination with the mold extraction forks 42, 44 also having been fully extended—the mold alignment block structures 50, 52 are aligned within the opening of the cassette assembly 210 and spaced above its shelves 264.

FIG. 5C shows the mold extraction assembly in a fully extended and lowered position. From the position shown in FIG. 5B, the feed box lifting structure 318, 320 lowers 76 the feed box and attached mold extraction assembly 10 to thus set the mold assembly 110 onto the shelves of the cassette assembly 210. More specifically, the mold assembly is lowered so that alignment dowels 262 located on a top surface of the shelves are received within complementary apertures formed on the lower surface of the mold assembly, outboard of the structures for receiving the alignment blocks on the forks. With the mold assembly now mounted on the cassette assembly 210, the extraction assembly is retracted to the intermediary position shown in FIG. 1. Retraction of the extraction assembly forks 42, 44 is preferably just enough to move the forks out of the way of a mold transfer assembly that moves a new cassette and mold assembly into place for transfer to the concrete products machine 110. In this way, it is preferred that the forks retract to the intermediary position shown in FIG. 1 rather than the fully retracted position as shown in FIG. 2 so as to save time.

FIG. 6 shows a front elevation view of the mold extraction assembly 10 mounted via a bottom plate 312 to a feed box 314 within an assembly 310. The mold extraction assembly is mounted upward against an underside of plate 312 as via bolts 78, 80 so that the assembly may be raised and lowered by means 318, 320 in fixed relation to the feed box 314.

FIG. 7 shows a magnified view of a right portion of the mold extraction assembly, and particularly fork 44 of such assembly lifting upward against a bottom side of the mold assembly 110, and particularly upward against mounting bracket extension 132. The extractor fork assembly is narrower than a space between the mold mount shelves so that the extractor fork assembly may fit within a space between the shelves and beneath the mold box mounted thereon. Upward movement of the fork 44 causes the alignment block 52 to be received within complementary aperture 140 formed inboard from the mold alignment aperture 136 on the bottom side of the mold assembly 110. Further upward movement causes the mounting bracket extension 132 to be lifted off of CPM shelf 134 and particularly off of mold alignment dowel 138.

Figure 8:
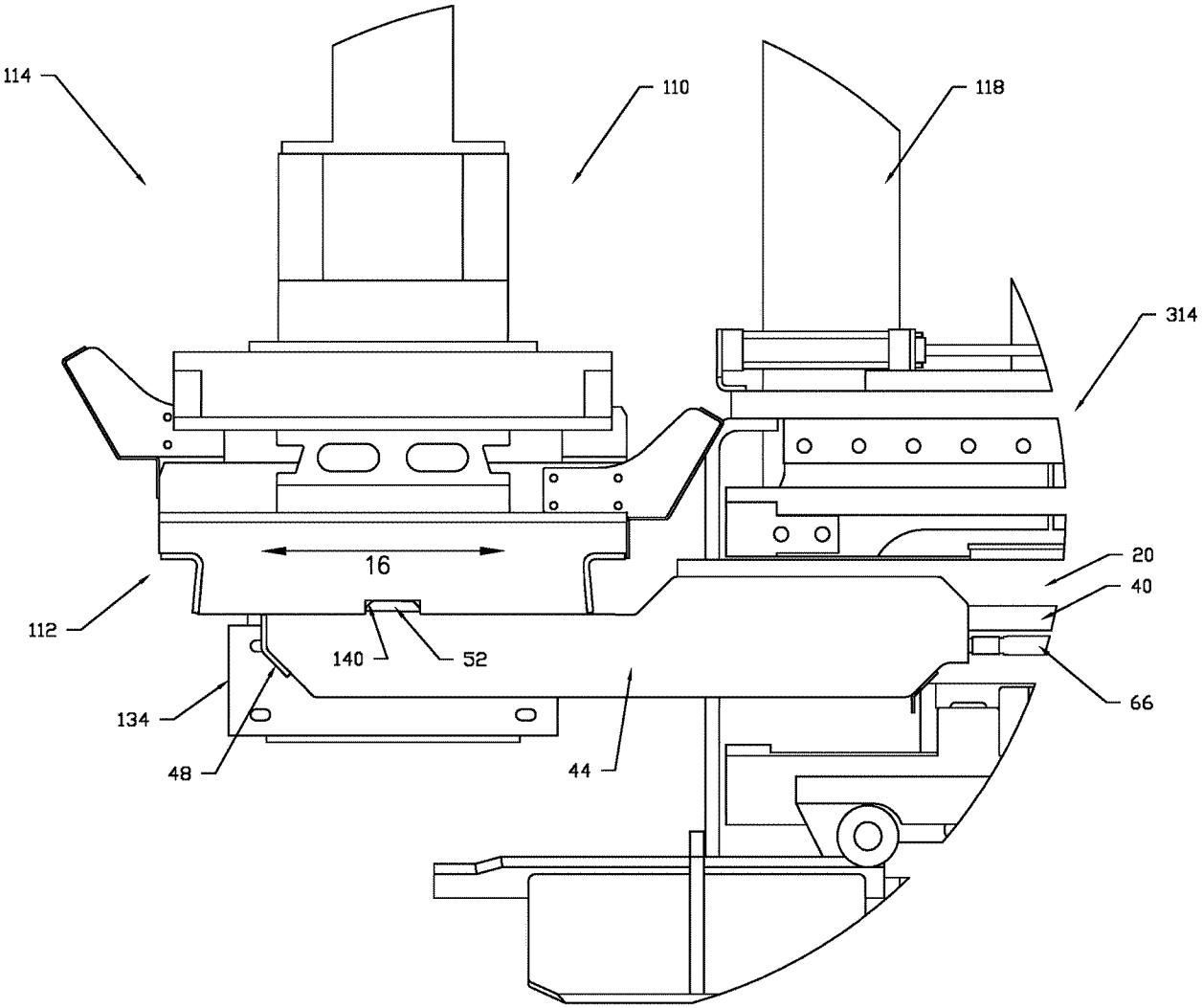
FIG. 8 is a side elevation section view of FIG. 7.

FIG. 8 shows a side elevation view in partial section of FIG. 7 showing the mold assembly 110 lifted above the top level of CPM shelf 134. When the dowel 138 is fully disengaged from aperture 136, the mold extractor may be moved 16 (FIG. 16) to a fully extended and lifted position as shown in FIG. 5B.

In summary, therefore, the mold extractor assembly is comprised of a mold extractor fork assembly which during mold change supports the mold assembly and is supported by the mold extractor arm assembly. Hydraulic cylinders are used to move the mold extractor fork assembly horizontally relative to the mold extractor arm assembly.

The mold extractor fork assembly is comprised of two extractor forks to support the mold assembly, tapered alignment blocks that indicate the correct position of the mold assembly on the two extractor forks, and mounted linear runner blocks that guide the mold extractor fork assembly on horizontal guide rails mounted to the mold extractor fork assembly. Each extractor fork has means for attaching to the rod end of a hydraulic cylinder to move the extractor forks relative to the mold extractor arm assembly.

The mold extractor arm assembly is comprised of two extractor arms that support the mold extractor fork assembly and are mounted to the top plate assembly of the rear feed drawer section. Horizontal guide rails are mounted to the extractor arms that support and guide the mold extractor fork assembly. Runner blocks are mounted to the extractor arms that are supported by guide rails mounted to the top plate assembly. The mold extractor arm assembly has a means for attaching the rod end of a hydraulic cylinder to move the mold extractor arm assembly relative to the top plate assembly.

The mold assembly is comprised of two main sections, the mold head assembly and the mold box assembly. These two sections are placed together by the center section assembly to be ready for transport by the mold extractor assembly. The position of the mold assembly for transport by the mold extractor assembly is indicated by tapered alignment blocks fitting into like holes in the mold box assembly.

Having described and illustrated the principles of the invention in a preferred embodiment thereof, it should be apparent that the invention can be modified in arrangement and detail without departing from such principles. For instance, it is understood that the hydraulic cylinders are just one aspect of drive means that can extend and retract the forks and arms of the mold extraction device and can take the form of hydraulics, pneumatics, electric screw-driven mechanisms, etc. We claim all modifications and variation coming within the spirit and scope of the following claims.

What is claimed is:

1. A mold extractor configured to move a mold assembly to and from a mounted position within a concrete products forming machine (CPM), the mold extractor comprising:

in a concrete products machine, a mold mounting structure in a CPM center section and a feed drawer assembly located to a rear of the CPM center section;

a lift mechanism coupled to the feed drawer assembly configured to vertically move the feed drawer assembly with respect to the mold mounting structure;

a guide rail assembly coupled to an underside of and vertically moveable with the feed drawer assembly via the lift mechanism;

an extractor arm assembly moveable horizontally along the guide rail assembly via a first extension assembly coupled to the extractor arm assembly;

an extractor fork assembly telescopically nested about the extractor arm assembly; and a second extension assembly, independent of the first extension assembly, coupled between the extractor arm assembly and the extractor fork assembly and configured to extend a horizontal reach of the mold extractor forwardly of the mold mounting structure, wherein the lift mechanism and first and second extension assemblies are operative to extend the extractor fork to an intermediate extended position just below the mold mounting structure, lift the extractor fork up against a mold resting on the mold mounting structure so that the mold is carried off the mold mounting structure, moving the mold forwardly to an extended position at a mold transfer assembly, and lowering the mold onto the mold transfer assembly.

2. The mold extractor of claim 1, wherein the mold mounting structure includes mold mount shelves and wherein the extractor fork assembly is narrower than a space between the mold mount shelves so that the extractor fork assembly may fit within the space between the shelves and beneath the mold mounted thereon.

3. The mold extractor of claim 1, further including alignment blocks located on top sides of the extractor fork assembly and configured to be received within complementary structures on an underside of the mold.

4. The mold extractor of claim 3, wherein the alignment blocks include a tapered top surface.

5. The mold extractor of claim 1, wherein the extraction fork assembly includes a pair of forks coupled together on a front end via a spreader plate.

6. The mold extractor of claim 1, wherein the extraction fork assembly includes a pair of forks coupled on either side of the extractor arm assembly and the second extension assembly includes a hydraulic cylinder coupled between the extractor arm assembly and each fork.

7. The mold extractor of claim 1, wherein the first and second extension assemblies are operative to move between three operative positions including a fully retracted position, the intermediate extended position where either the first or second extension assembly is fully extended, and the extended position where both the first and second extension assemblies are in a fully extended position.

8. The mold extractor of claim 1, wherein the first extension assembly includes a first hydraulic cylinder coupled to the extractor arm assembly and the second extension assembly includes a second hydraulic cylinder coupled between the extractor arm assembly and the extractor fork assembly.

9. The mold extractor of claim 1, wherein the first extension assembly includes a first hydraulic cylinder coupled to the extractor arm assembly and the second extension assembly includes a second hydraulic cylinder coupled between the extractor arm assembly and the extractor fork assembly.

* * * * *